United States Patent [19]

Raschle

[11] 3,943,693

[45] Mar. 16, 1976

[54] APPARATUS FOR FALSE-TWIST TEXTURING OF TEXTILE YARNS

[75] Inventor: Josef Raschle, Butschwil, Switzerland

[73] Assignee: Heberlein Maschinenfabrik AG., Wattwil, Switzerland

[22] Filed: Sept. 27, 1974

[21] Appl. No.: 509,953

[30] Foreign Application Priority Data

| | | |
|---|---|---|
| Oct. 1, 1973 | Switzerland | 14046/73 |
| Mar. 8, 1974 | Switzerland | 3264/74 |
| July 26, 1974 | Switzerland | 10284/74 |
| July 26, 1974 | Switzerland | 10285/74 |

[52] U.S. Cl. ..... 57/77.45

[51] Int. Cl.[2] ..... D02G 1/02; D02G 1/04

[58] Field of Search ..... 57/77.3–77.45, 57/34 R, 34 HS, 106

[56] References Cited

UNITED STATES PATENTS

| | | | |
|---|---|---|---|
| 3,036,423 | 5/1962 | Stoddard et al. | 57/77.45 X |
| 3,465,509 | 9/1969 | Parker et al. | 57/34 HS X |
| 3,578,751 | 5/1971 | Kodaira et al. | 57/77.45 |
| 3,595,003 | 7/1971 | Gassner | 57/77.45 |
| 3,726,073 | 4/1973 | Stutz | 57/77.45 X |
| 3,745,755 | 7/1973 | Keto | 57/77.4 |
| 3,756,006 | 9/1973 | Heinroth | 57/77.4 |
| 3,791,122 | 2/1974 | Raschle | 57/77.45 |

*Primary Examiner*—Donald E. Watkins
*Attorney, Agent, or Firm*—Fitzpatrick, Cella, Harper & Scinto

[57] ABSTRACT

A false-twist device comprises two axially parallel rollers rotatable about their axis for supporting a twist tube in the cuneal throat formed thereby, driving means for simultaneously driving the rollers, at least one yarn deviating element for feeding a yarn end to, or removing it from, the twist tube at a predetermined angle relatively to the tube axis, and means for holding the tube in place when no yarn is present in the tube.

19 Claims, 14 Drawing Figures

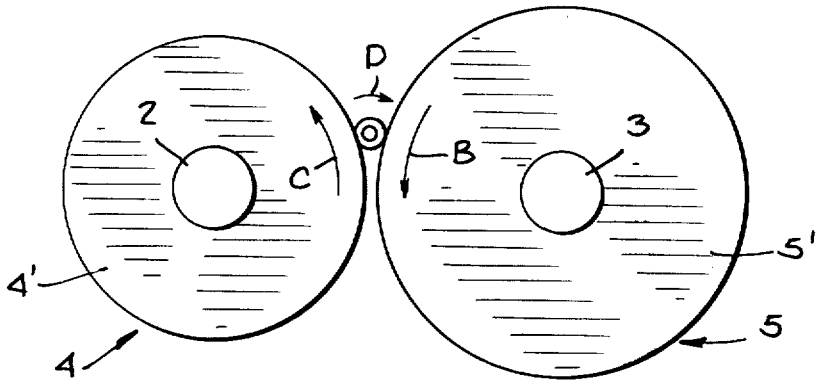
Fig. 6.
Fig. 7.
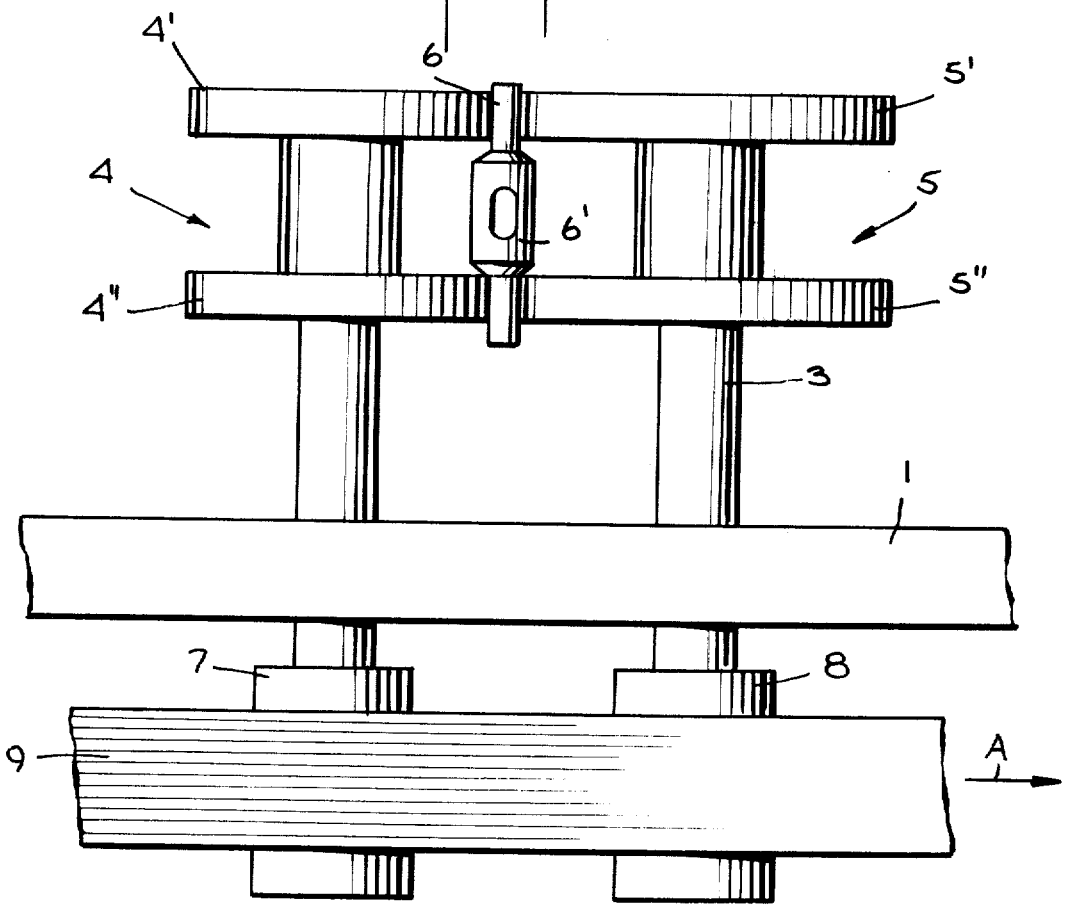

30
33
31
36
40
34
6
42
37
32
35
22
41
44
38
4'
4''
39
45
43
12
13
10
11
3
5'
2
4'
B
B

APPARATUS FOR FALSE-TWIST TEXTURING OF TEXTILE YARNS

This invention relates to false twist apparatus, and more particularly to such apparatus for texturing textile yarns by means of a rotating spindle or twist tube.

Developments in the false-twist texturing of textile yarns tend to achieve ever higher speeds of revolution of the twist tubes in order to permit increases in the linear speed at which the yarn is advanced through the false twist apparatus thereby to increase the quantity of product of textured yarns. False-twist devices are already known which comprise twist tubes which are positioned in the cuneal throat between two axially parallel rollers, and in tangential contact with the latter, one of the rollers being driven and the other idling, and wherein the twist tubes are pressed against the rollers by means of magnets. Such rollers may each consist of a pair of parallel discs separated by spacers or hubs and are well known in the art.

In a particular embodiment of this known device, each of the rollers consist of two parallel discs which are kept at the same distances from each other by means of spacer sockets, and magnetic attraction is achieved by means of a permanent magnet which is arranged in the center between the discs and the two spacer sockets.

It is already possible with this known false-twisting device to achieve speeds of the revolution of the twist tube of several hundred thousand r.p.m. However, if the revolution speed is further increased, difficulties arise which are due to intense heating of the twist tube by eddy currents which are formed under the influence of the magnetic field during rapid rotation of the driving and bearing rollers and by the important decrease of magnetization of the twist tube associated therewith, as well as the limited mechanical resistance of the magnetic materials used for the production of the twist tubes.

I contribute by the present invention a false-twist device which permits a further essential increase of the speed of revolution of the twist tube without the difficulties arising with the known false-twist devices.

According to an important aspect of my invention, I provide a device for false-twist texturing of textile yarns, comprising two axially parallel rollers each of which is rotatable about its axis and at least one twist tube supported within the throat formed by the rollers and in tangential contact therewith, characterized in that it comprises driving means for simultaneously driving the two rollers, as well as at least one yarn deviating element for feeding the yarn towards the twist tube and/or for removing it therefrom at a certain angle with respect to the axis of the twist tube, and means for holding the twist tube when no yarn is present in the twist tube.

By simultaneously driving the two rollers, the twist tube does not act as a driving roller for force transmission, as is the case when only one driving roller is used, i.e. no more energy is transmitted to the twist tube than is necessary for imparting twist to the yarn. By feeding the yarn towards the twist tube and by removing it therefrom at a certain angle with respect to the axis of the twist tube, the twist tube is pressed against the rollers by means of the force of yarn tension. Because of the elimination of magnetic means for pressing the twist tube against the driving rollers, the twist tubes may be made from suitable metal alloys, instead of magnetic materials, whereby essential higher mechanical resistance of the material can be achieved.

The yarn deviating member or members may be disposed so that the yarn is fed to the twist tube and removed therefrom at equal or different angles. Yarn feed towards the twist tube is advantageously effected at an angle of 90°, whereas yarn removal can be effected at smaller angles.

Additionally, the yarn deviating member or members may be shiftable in direction of yarn movement and/or in opposite direction so that the angles at which the yarn is fed to the twist tube or respectively removed therefrom, can be chosen depending on filament titer and material, and on yarn tension.

By way of example, the deviating element for feeding the yarn to the twist tube may be a roller which is not rotatable about its axis, or a pin, and the deviating member for removing the yarn may be a roller which is rotatable about its axis.

The means for holding the twist tube in the absence of yarn may consist of a holding element fixed on a lever pivotable transversely with respect to the twist tube axis and which may, for example, be constituted by a fork-like part, the ends of the fork legs in pivoted-in position lying opposite the ends of the twist tube at a certain distance, or by a circular disc, rotatable about its axis and fixed on a pivotable lever, the rim of which in pivoted-in position lies opposite the central position of the twist tube at a certain distance.

As I have already stated, the simultaneous driving of the two rollers makes it unnecessary for the twist tube to act as a driving wheel for force transmission, as would be the case if only one roller was used for driving. By feeding the yarn to the twist tube, and by removing it from the same at a certain angle with respect to the twist tube axis, pressing of the twist tube towards the rollers by means of yarn tension force is achieved.

Experience has shown however that in certain cases, especially when texturing textile yarns of relatively small titers, the admissible yarn tension is limited and may not be sufficient to assure safe pressing of the twist tube against the rollers.

Thus, according to a further aspect of the invention, I contribute a modification by which I am able to avoid the above-mentioned disadvantage, such modification being characterized in that the two axially parallel rollers or their respective driving rollers have different diameters, the two rollers being drivable so that the roller, the discs of which have the larger diameter, attract the twist tube into the cuneal throat. The ratio between the diameters of the roller discs may, for example, vary between 1:1.005 and 1:1.2.

For driving the twist tube, the two axially parallel rollers must be driven in the same sense, the twist tube which is in frictional contact with the surfaces of the rollers being attracted into the cuneal throat by one roller and urged out of the cuneal throat by the other. If the discs of both rollers have the same diameter, and therefore the same circumferential speed, the forces acting on the twist tube are equal, whereas, with different roller diameters, these forces are also different. If the diameter of the roller which attracts the twist tube into the cuneal throat is larger than the diameter of the other roller, there is created an additional force urging the twist tube against the rollers.

As I have already mentioned, in the absence of yarn, for example upon yarn breakage or if the device is out of operation, a holding element fixed on a lever pivotable transversely with respect to the axis of the twist tube or a circular disc rotatable about its axis, may be used. These mechanical means for holding the twist tube have proven to be quite satisfactory for the purpose. However, over a period of time, they may cause wear of the tube.

Thus, according to yet a further aspect of my invention, I provide, as means for holding the twist tube in the absence of yarn, a magnetic circuit which consists of two opposite permanent magnets having conical pole shoes and being connected by magnetic flux transmitting elements, the cone axes of the pole shoes being at least approximately congruent with the extended twist tube axis. The magnetic circuit may either be stationary or fixed on a lever swivellable transversely with respect to the twist tube axis.

As noted, feeding the yarn to the twist tube and by removing it from the same at a certain angle with respect to the axis of the twist tube, pressing of the twist tube against the rollers by means of the force of yarn tension is achieved. In false-twist texturing devices, it is known that the yarn tension is lower on the side of the twist tube on which the yarn is fed thereto than on the side on which the yarn is removed from the twist tube. This difference of tension may be substantial and possibly cause the twist tube to tilt away from the rim of the driving roller.

Therefore, according to another aspect of the invention, I provide a modification by which I am able to avoid the above-mentioned disadvantage. Thus, the twist tube may be shaped and supported by the rollers in operation such that its yarn input end extends father beyond the rims of the rollers than its yarn output end. The twist tube may comprise, away from its center, an enlarged portion which extends into the space between discs and which is engaged with the facing surfaces of the discs. The twist imparter may be lodged in the enlarged part of the twist tube or in a head provided at the input end of the twist tube.

There has thus been outlined rather broadly the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the designing of other structures for carrying out the several purposes of the invention. It is important, therefore, that the claims be regarded as including such equivalent construction as do not depart from the spirit and scope of the invention.

Specific embodiments of the invention have been chosen for purposes of illustration and description, and are shown in the accompanying drawings forming a part of the specification wherein.

Figure 5A:
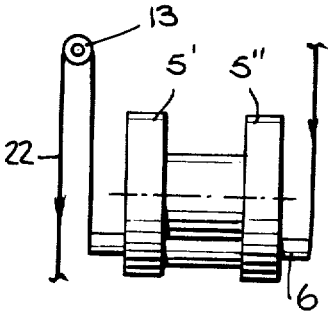
Figure 5B:
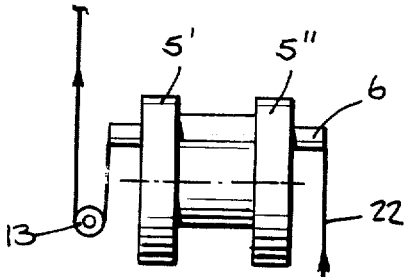
Figures 8, 9, 10:
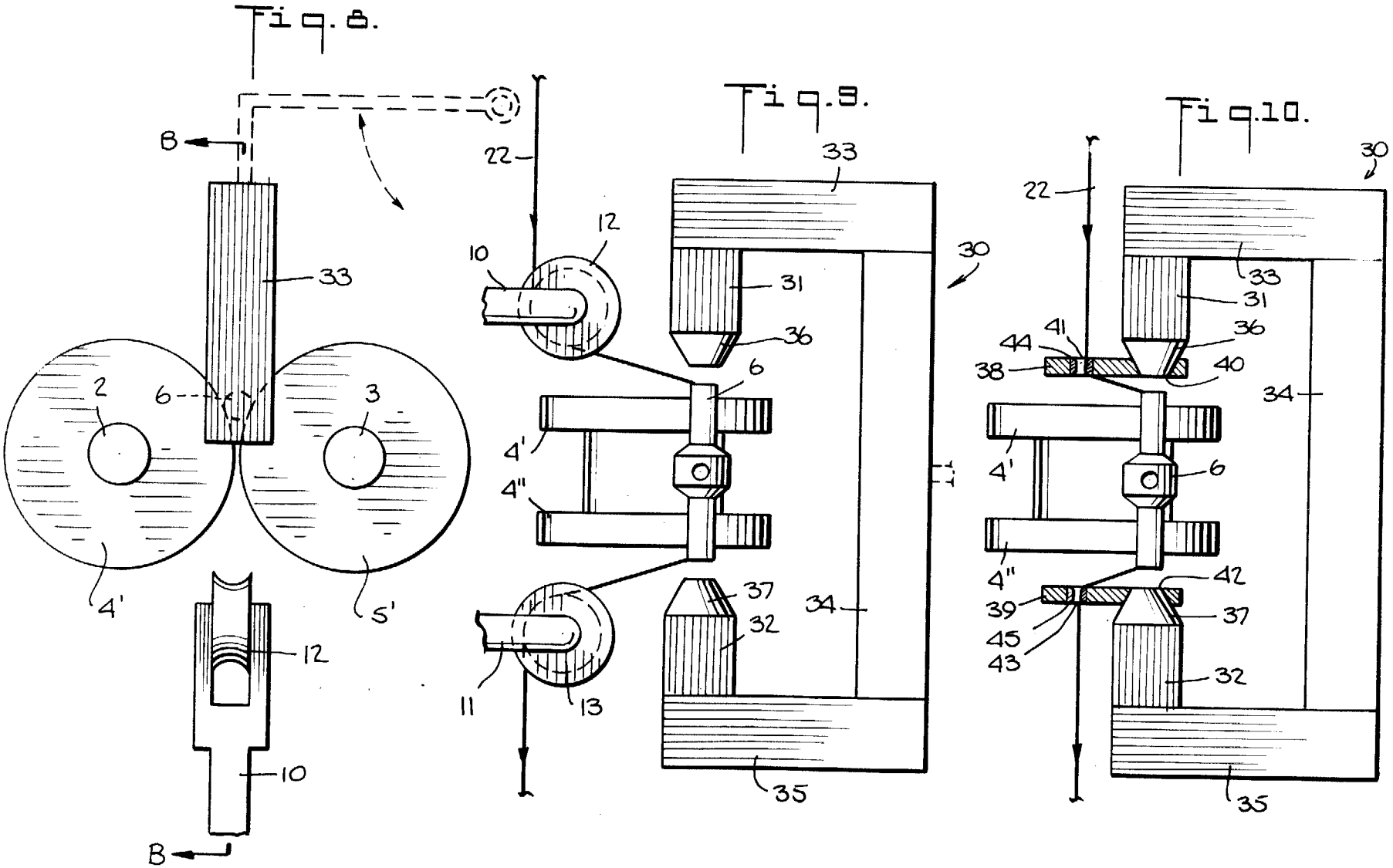
Figure 12:
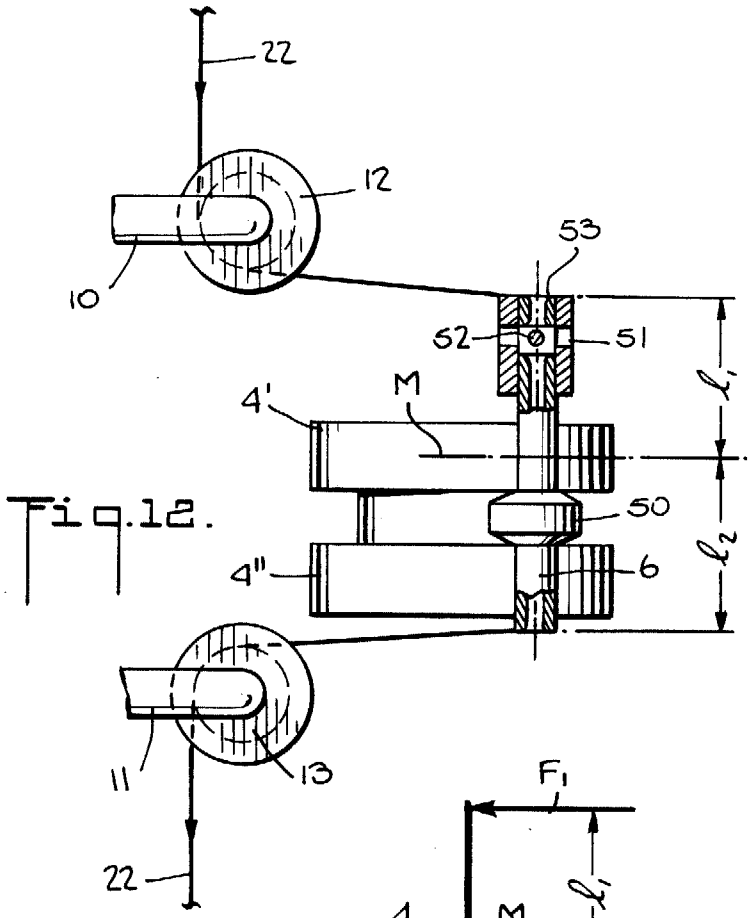
Figure 11:
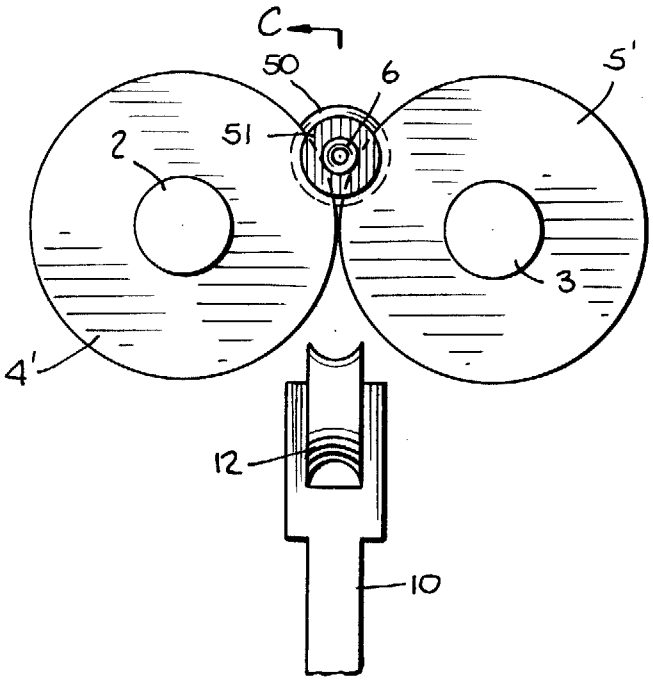

FIGS. 5*a* and 5*b* illustrate two further embodiments in side elevation;

FIGS. 6 and 7 illustrate a further modification of the invention;

FIG. 8 illustrates a further embodiment of the invention;

FIGS 9 and 10 are longitudinal sectional views taken along the line B — B of FIG. 8, illustrating alternative parts;

FIG. 11 is a top elevational view of another modification of the invention;

FIG. 12 is a plan view, partly in section, of the device of FIG, 11; and

Figure 13:
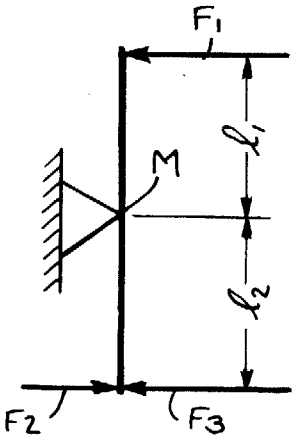

FIG. 13 is a schematic view illustrating forces acting on the twist tube.

Figure 1:
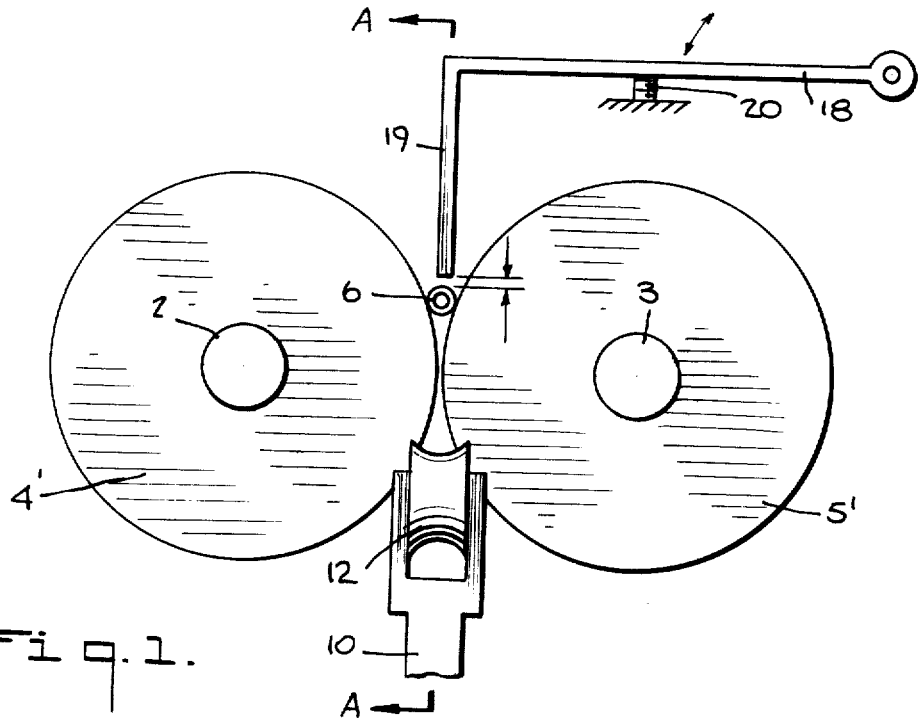
FIG. 1 is a top elevational view illustrating a first embodiment of the device of the present invention.
Figure 2:
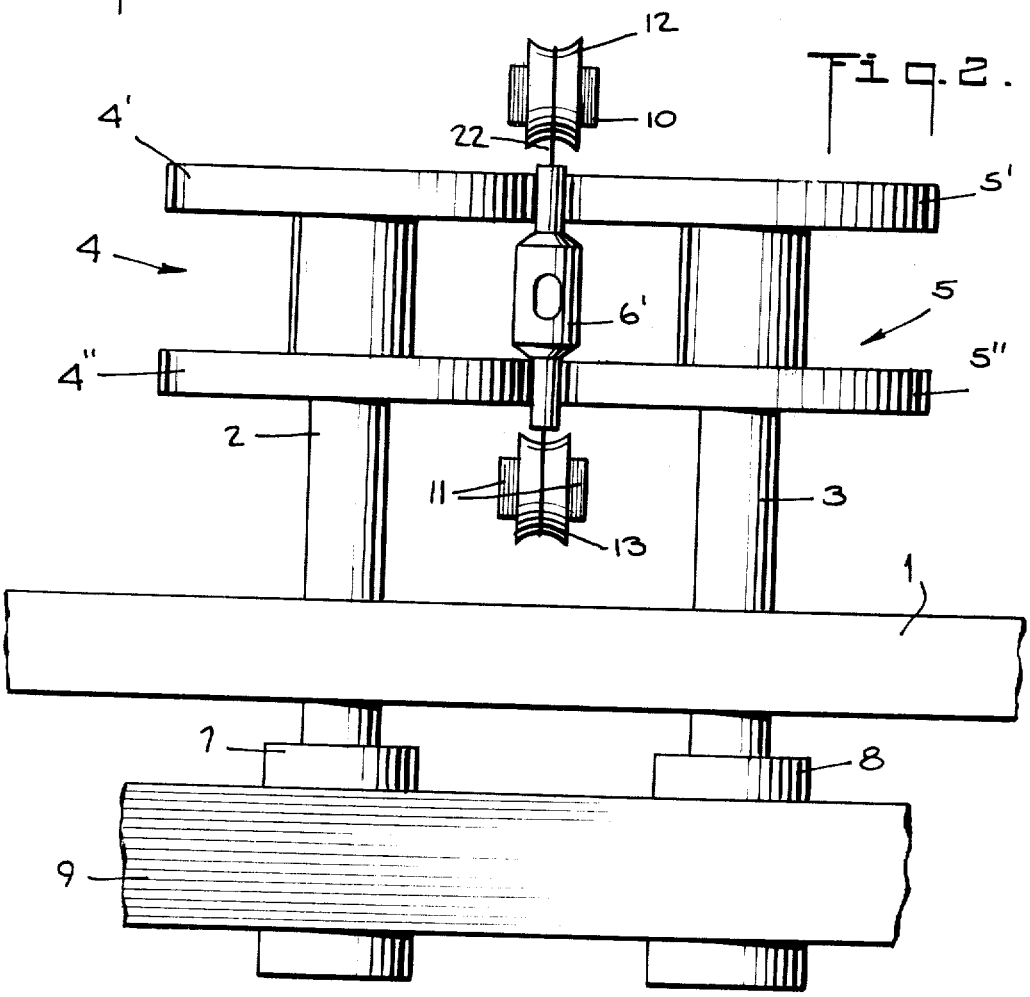
FIG. 2 is a front elevation of the device of FIG. 1.
Figure 3:
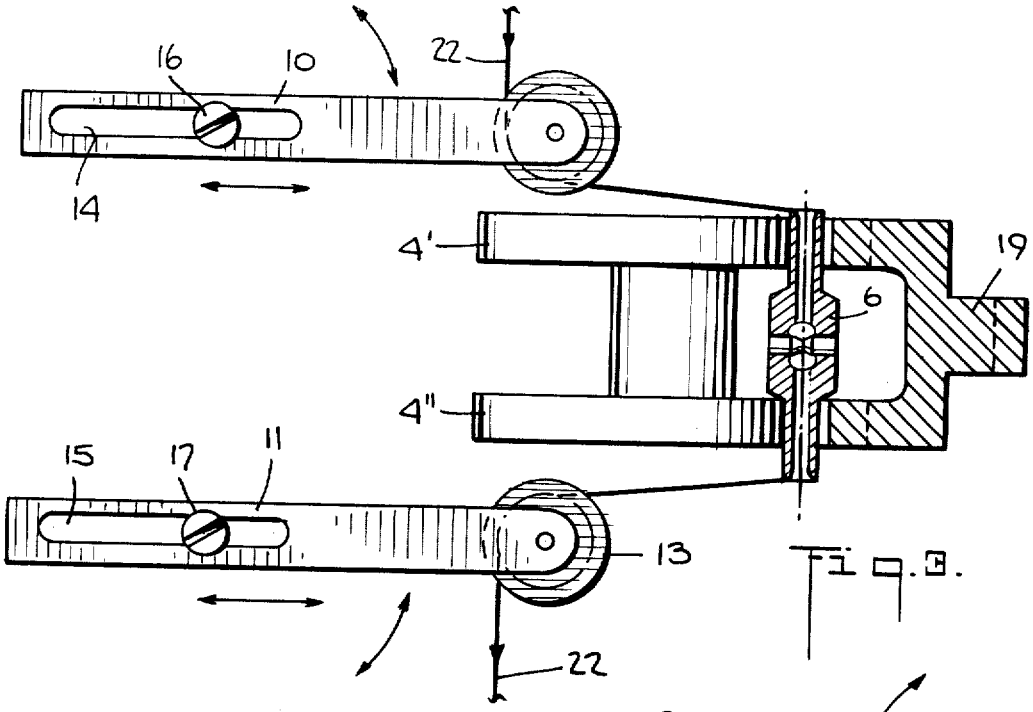
FIG. 3 is a longitudinal sectional view of a part of the device of FIG. 1 taken along line A — A.

The device of FIGS. 1 to 3 comprises a carrier plate 1 on which the vertical shafts 2 and 3 are lodged in throughbores. On the shafts 2 and 3, above the plate 1, I dispose the rollers 4 and 5, each of which consists of two discs 4′, 4″, and 5′, 5″, which are spaced from each other by spacer sockets. In one cuneal throat formed by the discs 4′, 4″ and 5′, 5″, the twist tube 6 is supported in parallel with the roller shafts. Below the plate 1, on each of the shafts 2 and 3, there is provided a roller 7, 8, respectively, over which the driving belt 9 passes and thereby drives the two rollers 4 and 5 in the same sense of rotation.

Above and below each of the rollers 4 and 5, there are provided support bars 10 and 11, respectively, on one end of each of which there are arranged yarn deviation members in the form of circular discs 12 and 13, each of which is formed with recessed or concave rims. The disc 12 which serves to feed the yarn 22 to the twist tube 6 consists of metal oxide ceramic material and is rigidly connected with the support bar 10. The disc 13, which serves to remove the yarn 22 from twist tube 6, consists of metal, and its axis is rotatably supported by ball bearings (not shown), provided in the forked extremities of support bar 11. Each of the support bars 10 and 11 comprises a longitudinal slot 14 and 15, respectively, through each of which is passed a screw 16 and 17, respectively, by means of which the two support bars are fixed on the machine frame in a manner not shown. The support bars 11 and 12 may either be pivotable about the screws 16 and 17 acting as pivots, or they may be shifted within the range of the longitudinal slots 14 and 15 in the direction of yarn movement or in the opposite direction.

Figure 4:
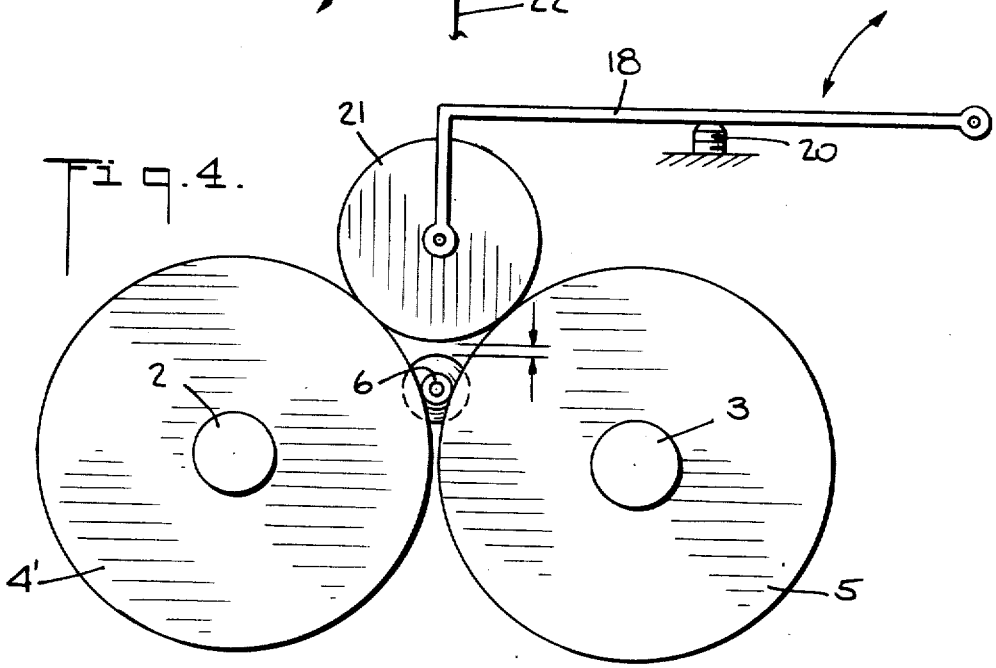
FIG. 4 is a modified embodiment according to FIG. 1 in top elevation.

In order to hold the twist tube 6 in the cuneal throat when there is no yarn, for example in case of yarn breakage or if the device is out of operation, there is provided, on a pivotable lever 18, a fork-like part 19, the ends of the fork arms, in pivoted-in position, (i.e., in its position closest to the twist tube 6) being situated opposite the two ends of the twist tube 6 at a distance of approximately 1 mm. The distance is maintained by means of bolt 20 onto which the lever 18 is applied. Instead of the fork-like part 19, there may also be provided on the pivotable lever 18 a circular disc 21 (FIG. 4) rotatable about its axis, the rim of which, in pivoted-in position, is situated opposite the enlarged central portion 6′ of twist tube 6 at a distance of approximately 1 mm.

The false-twist device according to the present invention may be used in a texturing machine comprising a plurality of processing stations situated beside each other in which the yarns move vertically in downward direction. In this case, as a rule, the false-twist device is arranged as shown in FIGS. 1 – 3, i.e., the axis of shafts 2 and 3 and of twist tube 6 extend vertically. It is then also possible to drive the rollers 7, 8 of the false-twist devices of all processing stations of the texturing machines by means of only one belt 9 which extends over the whole length of the machine.

It is however also possible to arrange the false-twist device in the texturing machine so that the axes of the shafts 2 and 3 and of twist tube 6 extend horizontally as shown in FIGS. 5*a* and 5*b*. In this case, only one deviating element 13 is needed for removing the yarn 22 from the twist tube, the yarn entering the twist tube 6 directly at a right angle. If yarn 22 moves in downward direction, the twist tube 6 must be supported in the lower cuneal throat of rollers 4 and 5 (FIG. 5*a*), and if yarn 22 moves in upward direction, the twist tube 6 must then be supported in the upper cuneal throat between rollers 4 and 5 (FIG. 5*b*).

Referring now to FIGS. 6 and 7, it will be seen that the driving belt 9 moves in direction of arrow A, the rollers 7, 8 and the rollers 4, 5 being thus driven in counterclockwise direction. As appears from FIG. 6, the twist tube 6 is attracted into the cuneal throat by roller 5 with the larger diameter (arrow B) and out of the cuneal throat by roller 4 having a smaller diameter (arrow C). The twist tube is rotated in clockwise direction (arrow D). Since the circumferential speed of the discs 5' and 5'' of roller 5 is larger than that of the discs 4', 4'' of roller 4, an additional force, acting on the twist tube 6 to press it towards the interior of the cuneal throat is achieved.

Instead of providing the rollers 4, 5 with discs of different diameters, driving rollers 7, 8 having different diameters may be provided. This also permits me to achieve different circumferential speeds of the discs of rollers 4 and 5 and therefore an additional force acting on the twist tube to press it towards the rollers.

Finally, of course, the discs of rollers 4 and 5, as well as their driving rollers 7, 8, may have different diameters.

Turning now to FIGS. 8 to 10, a magnetic circuit 30 consists of two mutually opposite permanent magnets 31, 32, which are connected by the magnetic flux transmitting elements 33, 34, 35. The permanent magnets 31, 32 provided with the conical pole shoes 36, 37, are arranged so that the cone axes of the pole shoes are congruent with the extended longitudinal axis of the twist tube 6. This arrangement of the magnets makes it possible for the magnetic flux to enter axially into the twist tube and to issue therefrom axially whereby the formation of eddy currents and excessive heating of the twist tube at high revolution speeds is avoided to a great extent.

The magnetic circuit 30 is connected with support plate 1 of the device in a manner not shown. It may as well, however, be fixed on a lever pivotable transversely with respect to the twist tube axis as indicated by the dashed lines in FIG. 8 so that it may be brought into operation only when needed.

According to the modified embodiment of the device of the present invention, shown in FIG. 10, as yarn deviating elements, two platelets 38, 39 are provided each of which is formed with two bores 40, 41 and 42, 43, respectively. The cone peaks of pole shoes 36, 37 penetrate through one of each set of bores 40 and 42 and are thereby rigidly connected with the platelets. In each of the other bores 41 and 43 which are laterally displaced with respect to the cone axes of the pole shoes, there is provided an annular insert 44 and 45, respectively, of corundum through which the yarn 22 is guided.

The permanent magnets may consist of aluminum-nickel-cobalt alloys, ferrites and cobalt-enriched intermetallic compounds with rare earths, especially of the type SECO5 — SE = Yttrium (Y), Lanthane, (La), Cerium (Ce), Praseodymum (Pr), Sumarium (Sm) and their mixtures.

Referring now to FIGS. 11 and 12, the twist tube 6 outside its center comprises an enlarged portion 50 which is engaged with surfaces of the discs 4' and 4'', and 5' and 5'' which form a recess between the discs, and prevents axial shifting of twist tube 6. In an enlarged head 51 provided at the yarn input end of the twist tube, a twist imparting pin 52 is arranged transversely with respect to the direction of yarn movement around which the yarn 22 is wrapped once. At the yarn input end of head 51, there is an annular insert 53 of corundum.

As in FIG. 13, the twist tube 6 must thus be considered as a scale-beam comprising a support point situated in the marginal center M of discs 4', 5', $l_1$ and $l_2$ being the two portions of the scale-beam. In the embodiment of FIGS. 11 and 12, the length of $l_1$ corresponds to the length of $l_2$. A force $F_1$ acts on the yarn input end of twist tube 6, the amount of which corresponds to the yarn tension between the yarn feeding device (not shown) and the twist imparter 52, and a force $F_3$ acts on the yarn output end of twist tube 6, the amount of which corresponds to the yarn tension between the twist imparter 52 and the yarn withdrawing device (not shown). Since $F_3$ is always larger than $F_1$, and in order to avoid tilting of the twist tube, a force $F_2$, acting against $F_3$, corresponding to the difference $F_3 - F_1$ must act on the output end of the twist tube. As appears from FIG. 13, the following relation results:

$$\frac{F_3 - F_1}{F_1} = \frac{F_2}{F_1} = \frac{l_1}{l_2}$$

In the following table, some examples of the force conditions as they appear in practise while texturing a 167 dtex multifilament yarn of synthetic material (polyamide, polyester) are given. This table shows that the ratio of the lengths of the scale-beams, $$\frac{l_1}{l_2}$$

must lie approximately between 0.7:1 and 3:1 to achieve the necessary force compensation.

TABLE

| Example | $F_1$ in p | $F_3$ in p | $F_3-F_1=F_2$ in p | $l_1:l_2$ |
|---|---|---|---|---|
| 1 | 30 | 50 | 20 | 0.66:1 |
| 2 | 25 | 50 | 25 | 1:1 |
| 3 | 20 | 50 | 30 | 1.5:1 |
| 4 | 15 | 50 | 35 | 2.33:1 |
| 5 | 10 | 50 | 40 | 4:1 |

The device according to the present invention is particularly suitable for the false-twist texturing of textile yarns or filament bundles of thermoplastic synthetic material such as polyamides and polyesters. It is then possible to fullfil the longfelt need for very high twist tube revolution and yarn advance speeds even with relatively coarse yarns or filament bundles, having, for example, total titers exceeding 110 dtex.

I believe that the construction and operation of my novel false-twist device will now be understood and that the advantages thereof will be fully appreciated by those persons skilled in the art.

I claim:

1. Device for false-twist texturing of yarns, comprising two axially parallel rollers which are rotatable about their respective axes and at least one twist tube supported within a throat formed by the rollers and in tangential contact therewith, driving means for simultaneously driving the two rollers, yarn deviating means for feeding the yarn to the twist tube and removing it from the same at a predetermined angle so that the twist tube is pressed against the rollers by means of the force of the yarn tension and means for maintaining the position of the twist tube relative to the rollers when no yarn is present in the twist tube.

2. Device according to claim 1, characterized in that the yarn deviating means include an element for feeding the yarn to the twist tube, the same being a stationary roller or a pin, and a yarn deviating element for removing the yarn, the same being a roller rotatable about its axis.

3. Device according to claim 2, characterized in that the stationary roller or the pin consist of metal oxide ceramic material.

4. Device according to claim 1, characterized in that the two axially parallel rollers have different diameters, and in that the driving means drive the rollers so that the roller with the larger diameter is effective to urge the twist tube into the cuneal throat between the rollers.

5. Device according to claim 4, characterized in that the ratio between diameters of the rollers is of the order of between 1:1.005 and 1:1.2.

6. Device according to claim 1, characterized in that the driving means drive the rollers at different circumferential speeds.

7. Device according to claim 6, characterized in that the ratio of circumferential speeds of such rollers are of the order of between 1:1.005 and 1:1.2.

8. Device according to claim 1, characterized in that, as means for maintaining the position of the twist tube relative to the rollers in the absence of yarn, a magnetic system is used which consists of two oppositely arranged permanent magnets with conical pole shoes connected by magnetic flux transmitting elements, the cone axes of the pole shoes being at least approximately congruent with the extended twist tube axis.

9. Device according to claim 8, characterized in that the magnetic system is stationary.

10. Device according to claim 8, characterized in that the magnetic system is fixed on a lever pivotable transversely with respect to the axis of the twist tube.

11. Device according to claim 8, characterized in that, as yarn deviating elements, two platelets are provided each of which has two bores, each of the cone peaks of the pole shoes penetrating a bore and being rigidly connected within the latter with one of the platelets.

12. Device according to claim 11, characterized in that, in each of the other bores of the platelets, there is provided an annular insert of corundum.

13. Device according to claim 8, characterized in that the permanent magnets consist of intermetallic, cobalt-enriched compounds with rare earths.

14. Device according to claim 1, characterized in that the twist tube is supported in operation by the rollers so that its yarn input ends extends farther beyond the rims of the rollers than its yarn output end.

15. Device according to claim 14, characterized in that the twist tube comprises an enlarged portion which engages facing surfaces of parallel discs.

16. Device for false-twist texturing of yarns comprising two axially parallel rollers which are rotatable about their respective axes and at least one twist tube supported within a throat formed by the rollers in tangential contact therewith, yarn deviating means including an element for feeding the yarn to the twist tube at a predetermined angle, said element being a stationary roller or a pin and an element for removing the yarn from the twist tube at a predetermined angle, said element being a roller rotatable about its axis, whereby pressing of the twist tube against the rollers by means of the force of yarn tension is achieved, and means for maintaining the position of the twist tube relative to the rollers when no yarn is present in the twist tube.

17. Device according to claim 16, said yarn deviating elements being mounted on support bars which are shiftable along the line of yarn movement to adjust the yarn feed and removal angles.

18. Device for false-twist texturing of yarns, comprising two axially parallel rollers which are rotatable about their respective axes and at least one twist tube supported within a throat formed by the rollers and in tangential contact therewith, driving means for simultaneously driving the two rollers, said rollers having different diameters and said driving means driving the rollers so that the roller with the larger diameter is effective to urge the twist tube into the cuneal throat between the rollers, yarn deviating means for guiding the yarn to the twist tube and removing it from the same at a predetermined angle so that the twist tube is pressed against the rollers by means of the force of the yarn tension and means for maintaining the position of the twist tube relative to the rollers when no yarn is present in the twist tube.

19. Device according to claim 1, wherein the twist tube comprises an enlarged portion which engages facing surfaces of parallel discs of said axially parallel rollers, said enlarged portion being off-center relative to the twist tube so that the input end of the twist tube extends farther beyond the rims of said discs than its output end.

* * * * *

UNITED STATES PATENT OFFICE

CERTIFICATE OF CORRECTION

Patent No. 3,943,693 Dated March 16, 1976

Inventor(s) JOSEF RASCHLE

It is certified that error appears in the above-identified patent and that said Letters Patent are hereby corrected as shown below:

Column 8, kindly cancel claims 14 and 15.

On the cover sheet, after the abstract, "19 Claims" should read --17 Claims--

Signed and Sealed this

Twenty-fourth Day of August 1976

[SEAL]

*Attest:*

RUTH C. MASON
*Attesting Officer*

C. MARSHALL DANN
*Commissioner of Patents and Trademarks*